US005440883A

United States Patent [19]

Harada

[11] Patent Number: 5,440,883

[45] Date of Patent: Aug. 15, 1995

[54] PULSE-TUBE REFRIGERATOR

[76] Inventor: Shintaro Harada, 73-2, Nakaawahara, Kumami-Choo, Nishio-City, Aichi-Pref., Japan

[21] Appl. No.: 295,277

[22] Filed: Aug. 24, 1994

[51] Int. Cl.[6] ..... F25B 9/00

[52] U.S. Cl. ..... 62/6; 60/520

[58] Field of Search ..... 62/6, 467; 60/520

[56] References Cited

U.S. PATENT DOCUMENTS 5,107,683 4/1992 Chan et al. ..... 62/6
5,269,147 12/1993 Ishizaki et al. ..... 62/6
5,275,002 1/1994 Inoue et al. ..... 62/6

*Primary Examiner*—Ronald C. Capossela

[57] ABSTRACT

A double piston type pulse-tube refrigerator includes a compression cylinder, a compression piston reciprocably disposed within the compression cylinder, an expansion cylinder, an expansion piston reciprocating at preceding phase angle of about a quarter cycle and disposed within the expansion cylinder, a high temperature heat exchanger for cooling effectively working gas under compression stage interposed between the compression cylinder and the expansion cylinder, a regenerator connected to the high temperature heat exchanger, a low temperature heat exchanger connected to the regenerator and a pulse tube connected to the low temperature heat exchanger and the high temperature heat exchanger, a rotor with 4 magnetic poles constructed in a crank shaft and a ring with 4 magnetic poles corresponding to the rotor position disposed within a crank case for compensating torque unbalance.

4 Claims, 4 Drawing Sheets

PULSE-TUBE REFRIGERATOR

BACKGROUND OF THE INVENTION

1. Field of the Invention

This invention relates generally to a refrigerator, and more particularly to a double piston type pulse-tube refrigerator.

2. Description of the Prior Art

A double piston type pulse-tube refrigerator is well advanced in several types of pulse-tube refrigerator. The double piston type pulse-tube refrigerator usually includes a housing having a compression cylinder and a compression piston slidably reciprocating within the compression cylinder, a compression cylinder head covering the compression cylinder, an expansion cylinder and an expansion piston slidably reciprocating within the expansion cylinder at a preceding phase angle of about 15 degrees, an expansion cylinder head covering the expansion cylinder, a high temperature heat exchanger connected to the compression cylinder head, a regenerator connected to the high temperature heat exchanger, a low temperature heat exchanger connected to the regenerator and a pulse-tube connected to the low heat exchanger and to the expansion cylinder head on both sides.

When the both pistons reciprocate, pressure oscillation and displacement of working fluid occur mainly in the regenerator, and the temperature at a high temperature side of the regenerator becomes higher and the temperature of an opposite side of the regenerator becomes lower by means of heat flow from a low temperature side to a high temperature side. A heat of refrigerating power is absorbed by the low temperature heat exchanger and sent to the regenerator. The heat come from the regenerator and the heat of compression work are absorbed by the high temperature heat exchanger.

The large friction losses of the regenerator and the high temperature heat exchanger, and the surplus spaces of them restrain the refrigerating power, and the low phase angle between the compression piston and the expansion piston is not well accommodated to a housing configuration.

SUMMARY OF THE INVENTION

It is therefore an object of the invention to provide an improved double piston type pulse-tube refrigerator which obviates the above conventional drawbacks.

It is another object of the invention to provide an improved refrigerator which includes a mechanism compensating torque unbalance occurred by forces of the compression piston and the expansion piston.

According to the invention, the refrigerator includes a compression cylinder, a compression piston reciprocating within the compression cylinder, a compression cylinder head connected to a two-way port of the high temperature heat exchanger, an expansion piston reciprocating within the expansion cylinder at a preceding phase angle of about a quarter cycle, an expansion cylinder head connected to another two-way port of the high temperature heat exchanger, a regenerator connected to the two-way port of the high temperature heat exchanger, a low temperature heat exchanger connected to the regenerator, a pulse tube connected to the regenerator and to the other two-way port of the high temperature heat exchanger, a rotor with 4 magnetic poles constructed in a crank shaft and a ring with 4 magnetic poles disposed within a crank case corresponding to the rotor position.

BRIEF DESCRIPTION OF THE DRAWINGS

Further objects and features of the present invention will be understood more clearly from the following detailed description of the embodiments thereof, when read with reference of the drawings in which.

DETAILED DESCRIPTION OF THE INVENTION

Figure 1:
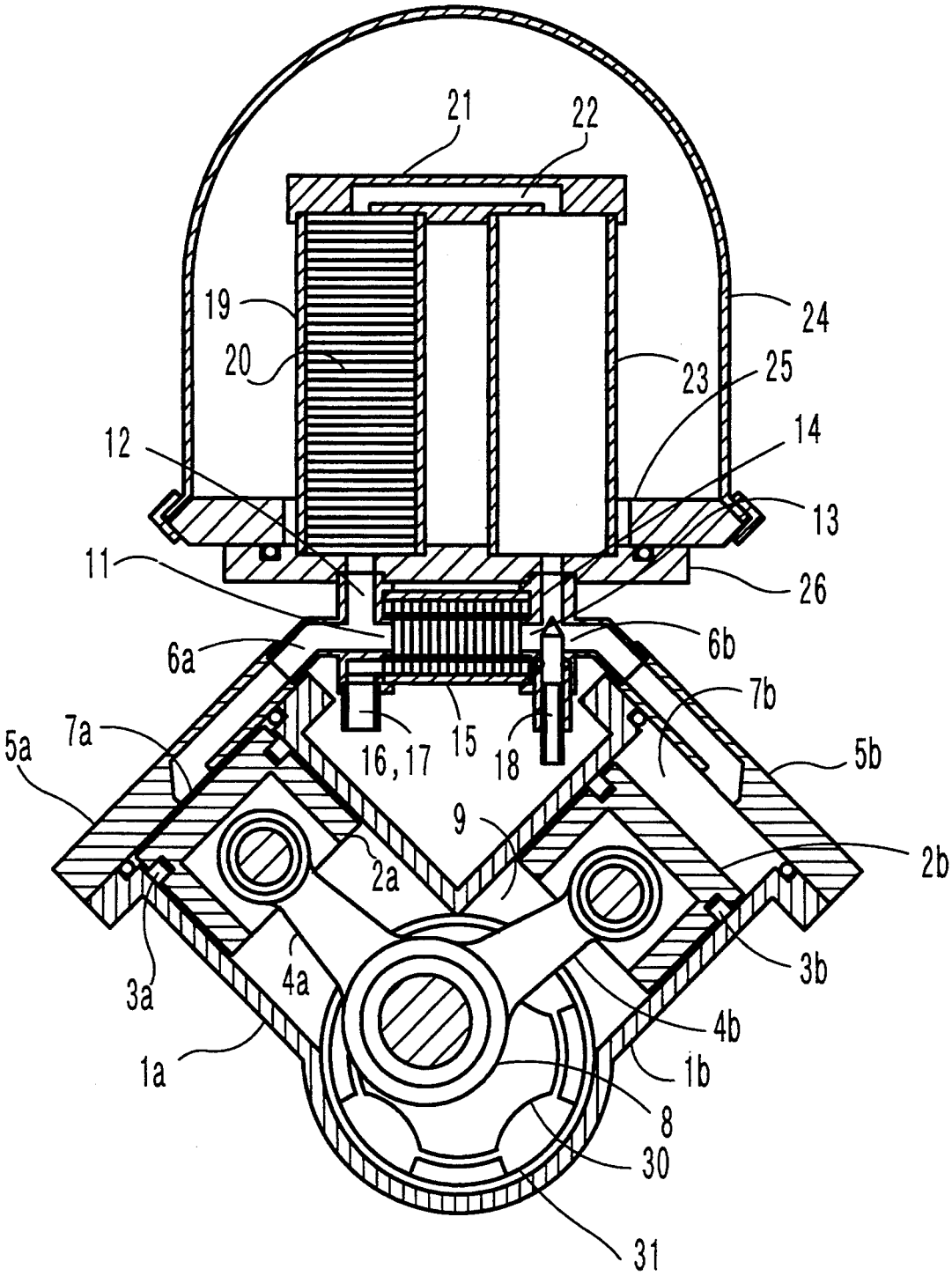
FIG. 1 shows a cross-sectional view of the refrigerator according to the invention.
Figure 2:
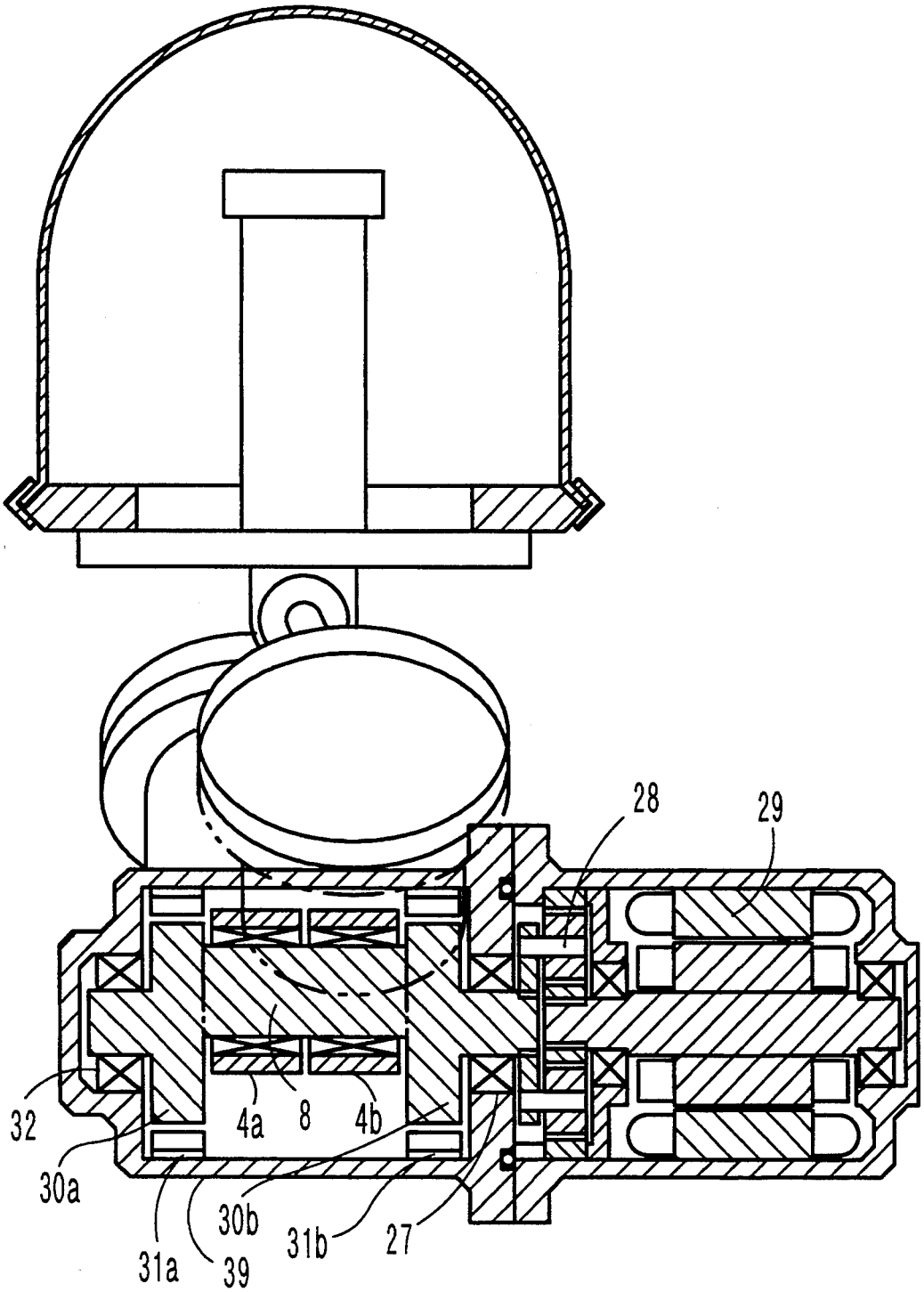
FIG. 2 shows a partial cross-sectional view of embodiment of the invention.
Figure 3:
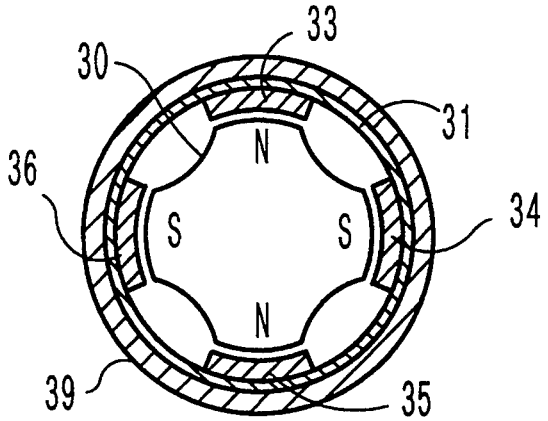
FIG. 3 shows a partial cross-sectional view of the first stage mechanism of compensating torque unbalance.
Figure 4:
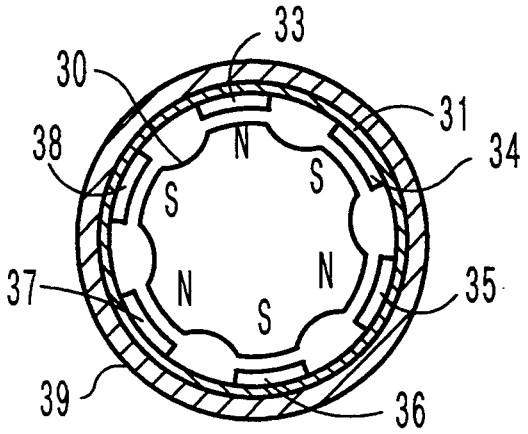
FIG. 4 shows a partial cross-sectional view of the second stage mechanism of compensating torque unbalance.

In FIG. 1, a compression cylinder 1*a* has a compression piston 2*a* therein which is connected to a crank shaft 8 through compression piston rod 4*a*. The compression piston 2*a* divides the interior of the compression cylinder 1*a* into two, one being compression chamber 7*a* as a mainly compression space and the other being crank chamber 9. The compression piston 2*a* is reciprocable within the compression cylinder 1*a*. A compression cylinder head 5*a* is covering the compression cylinder 1*a*. An expansion cylinder 1*b* has an expansion piston 2*b* therein which is connected to a crank shaft 8 through expansion piston rod 4*b*. The expansion piston 2*b* divides the interior of the expansion cylinder 1*b* into two, one being expansion chamber 7*b* as a mainly expansion space and the other being crank chamber 9. The expansion piston 2*b* is reciprocable within the expansion cylinder 1*b* at a preceding phase angle of about a quarter cycle. An expansion cylinder head 5*b* is covering the expansion cylinder 1*b*. A high temperature heat exchanger 15 is interposed between the compression cylinder head 5*a* and the expansion cylinder head 5*b*, and connected to them via both two-way ports 6*a*, 6*b* of the high temperature heat exchanger 15 and to a flange 26 via both other two-way ports 12,14 of the high temperature heat exchanger 15. A regenerator 19 is connected to the two-way port 12 of the high temperature heat exchanger 15 via the flange 26. A plurality of meshes 20 having large heat capacities and heat transfer surfaces are disposed in layers in the regenerator 19. A low temperature heat exchanger 21 is connected to the regenerator 19. A pulse tube is connected to the low temperature heat exchanger 21 and to the two-way port 14. An adjustable valve 18 is disposed within the high temperature heat exchanger and controls working fluid flowing through the two-way port 14. Compression piston ring 3*a* is provided on the outer periphery of the compression piston 2*a* for sealingly reciprocating the compression piston 2*a* within the compression cylinder 1*a*. Expansion piston ring 3*b* is provided on the outer periphery of the expansion piston 2*b* for sealingly reciprocating the expansion piston 2*b* within the expansion cylinder 1*b*.

In FIG. 1, FIG. 2, FIG. 3 and FIG. 4, a rotor 30*a* with 4 poles of permanent magnet is constructed in the crank shaft 8. A ring 31*a* with 4 poles of permanent magnet is disposed within a crank case 39 corresponding to the rotor 30*a* position. Magnetic N poles are 33 and 35. Magnetic S poles are 34 and 36. A rotor 30*b* with 6 poles of permanent magnet is constructed in the crank shaft 8. Magnetic N poles are 33,35 and 37. Magnetic S poles are 34,36 and 38. A ring 31*b* with 6 poles of permanent magnet is disposed within a crank case 39 corresponding to the rotor 30*b* position. A planetary gear 28 is connected to the crank shaft 8 and a driving motor 29.

Operation

When the compression piston 2*a* is moved downwardly from the middle point to the lowerdead position and at the same time the expansion piston 2*b* is moved upwardly from the lowerdead position to the middle point, the pressure of the working fluid in the working space such as the compression chamber 7*a*, the expansion chamber 7*b* and other spaces in the high temperature heat exchanger 15, in the regenerator 19, in the low temperature heat exchanger 21 and in the pulse tube 23 becomes low. When the compression piston 2*a* is moved upwardly from the middle point to the upperdead position and the expansion piston 2*b* is moved downwardly from the upperdead position to the middle point, the pressure of the working fluid becomes high. Due to the above motions, high pressure oscillation and large displacement of the working fluid occur mainly in the regenerator 19 and the pulse tube 23 because of flowing path not having any high temperature heat exchanger. According to this phenomenon, increased refrigerating power is absorbed effectively by the low temperature heat exchanger 21, and is transferred to the high temperature heat exchanger through the regenerator 19. On the other hand, more large displacement of other working fluid flowing through the high temperature heat exchanger 15 occurs because of working fluid directly moved by the compression piston and the expansion piston. And the heats of refrigerating power and compression work are absorbed effectively by the high temperature heat exchanger 15 and discharged out by coolant flowing from port 16 to 17 of the high temperature heat exchanger 15. The adjustable valve 18 controls mutual flow rate of both working fluids flowing in the regenerator 19 and in the high temperature heat exchanger 15.

FIG. 1, FIG. 2, FIG. 3 and FIG. 4 shows another embodiment of the invention wherein, a first stage rotor 30*a* with 4 poles of permanent magnet is constructed in the side of the crank shaft 8. A first stage ring 31*a* with 4 poles of permanent magnet including two magnetic N poles 33,35 and two magnetic S poles 34,36 is disposed within a crank case 39 corresponding to the first stage rotor 30*a* position. A second stage rotor 30*b* with 6 poles of permanent magnet is constructed in the other side of the crank shaft 8. A second stage ring 31*b* with 6 poles of permanent magnet including three magnetic N poles 33,35,37 and three magnetic S poles 34,36,38 is disposed within the crank case 39 corresponding to the second stage rotor 30*b* position. According to this embodiment, the first or second stage rotor is forced rotating forward or backward from the angles of the rotor where the magnetic poles of the rotor coincides with the same magnetic poles of the ring to the next other angles of one where the magnetic poles of the rotor coincides with the opposite magnetic poles of the ring.

Figure 5:
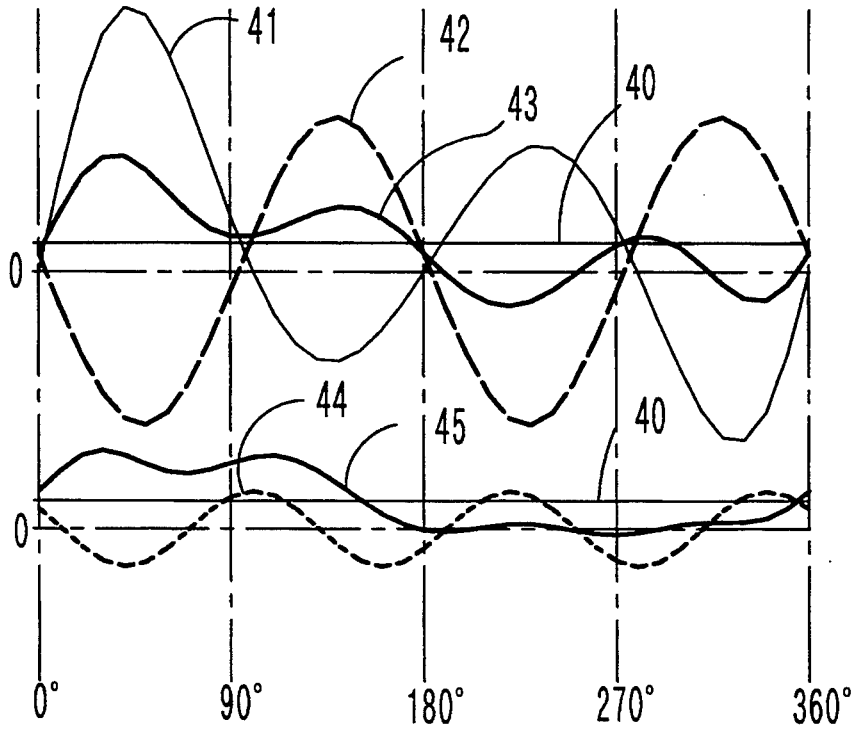
FIG. 5 shows a graph of torques.

FIG. 5 shows a first torque line 41 occurred originally by the pressures of the compression chamber 7*a* and the expansion chamber 7*b*, a first stage compensating line 42 occurred by the interaction of the first stage rotor 30*a* and ring 31*a*, a second torque line 43 compensated by the first stage compensating line 42, a second stage compensating line 44 occurred by the interaction of the second stage rotor 30*b* and the ring 31*b*, a third torque line 45 compensated by the second stage compensating line 44. According to this embodiment, a torque needed for a driving motor 29 can be largely reduced by means of small fluctuation of the third torque at about a fourth part of the first torque.

Obviously, numerous modifications and variations of the present invention are possible in light of the above teachings. It is therefore to be understood that within the scope of the appended claims, the invention may be practiced otherwise than as specifically described herein.

What is claimed is:

1. A refrigerator comprising:

a housing having a compression cylindrical portion and a expansion cylindrical portion therein;

a reciprocable compression piston disposed in said compression cylindrical portion of said housing and fluid-tightly dividing said compression cylindrical portion into compression and crank chambers;

a compression cylinder head covering said compression cylindrical portion;

an expansion piston disposed in said expansion cylindrical portion of said housing, reciprocating at a preceding phase angle of about a quarter cycle, and fluid-tightly dividing said expansion cylindrical portion into expansion and crank chambers;

an expansion cylinder head covering said expansion cylindrical portion;

a high temperature heat exchanger connected between said compression cylinder head and said expansion cylinder head having two-way ports in both sides;

a flange connected to said high temperature heat exchanger;

a regenerator connected to said flange and including a plurality of regenerative materials;

a low temperature heat exchanger connected said regenerator;

a pulse tube connected between said low temperature heat exchanger and said flange.

2. A refrigerator according to claim 1, wherein an adjustable valve disposed within said high temperature heat exchanger or said flange or said cylinder head.

3. A refrigerator according to claim 1, wherein said housing further includes a first stage rotor with 4 poles of magnetic material constructed in a crank shaft, and a first stage ring 4 poles of magnetic material corresponding to said first stage rotor position.

4. A refrigerator according to claim 3, wherein said housing further includes a second stage rotor with 6 poles of magnetic material constructed in a crank shaft and a second stage ring with 6 poles of magnetic material corresponding to said second stage rotor position.

* * * * *